US010197370B2

(12) United States Patent
Zhang

(10) Patent No.: US 10,197,370 B2
(45) Date of Patent: Feb. 5, 2019

(54) SINGLE-SLOT CARTRIDGE CLIP HOLDER

(71) Applicant: Cytac Technology Limited, Shenzhen (CN)

(72) Inventor: Joe Zhang, Shenzhen (CN)

(73) Assignee: CYTAC TECHNOLOGY LIMITED, Shenzhen (CN)

( * ) Notice: Subject to any disclaimer, the term of this patent is extended or adjusted under 35 U.S.C. 154(b) by 133 days.

(21) Appl. No.: 15/585,580

(22) Filed: May 3, 2017

(65) Prior Publication Data

US 2018/0292191 A1 Oct. 11, 2018

(30) Foreign Application Priority Data

Apr. 11, 2017 (CN) ..... 2017 2 0370893 U

(51) Int. Cl.
*F42B 39/00* (2006.01)
*F42B 39/02* (2006.01)

(52) U.S. Cl.
CPC ..... *F42B 39/02* (2013.01)

(58) Field of Classification Search
CPC ..... F42B 39/02
USPC ..... 224/245
See application file for complete search history.

(56) References Cited

U.S. PATENT DOCUMENTS 1,756,677 A * 4/1930 Cook ..... F42B 39/02 206/3
5,174,482 A * 12/1992 Rogers ..... F42B 39/02 221/185
8,011,544 B1 * 9/2011 Howell ..... A45F 5/02 224/196
8,733,606 B2 * 5/2014 Felts ..... F42B 39/02 224/245
8,887,972 B2 * 11/2014 Solomon ..... A45F 5/02 224/245
8,887,977 B2 * 11/2014 Ralph ..... F42B 39/02 224/245
2006/0022007 A1 * 2/2006 Hughes ..... A45F 5/00 224/671
2007/0278269 A1 * 12/2007 Rogers ..... F41A 9/65 224/239
2008/0105722 A1 * 5/2008 Howell ..... A41D 13/0012 224/671
2008/0277436 A1 * 11/2008 Wilson ..... F41A 9/65 224/239

* cited by examiner

*Primary Examiner* — Peter Helvey
(74) *Attorney, Agent, or Firm* — Muncy, Geissler, Olds & Lowe, P.C.

(57) ABSTRACT

The utility model discloses a single-slot cartridge clip holder comprising a front housing, a rear housing, positioning rack slots, adjustable rack arms and a screw hole, wherein the adjustable rack arms are arranged at two sides of the front housing, the rear housing is mounted at a rear part of the front housing, the positioning rack slots matching the adjustable rack anus are arranged at two sides of the rear housing, a slidably adjustable mounting hole is arranged at a middle part of a connection between the front housing and the bottom of the rear housing, an integrally formed pressure elastic piece is arranged at an inner side of the rear housing, and positioning screw holes are arranged at two sides near a top end of a pressure elastic piece.

3 Claims, 6 Drawing Sheets

SINGLE-SLOT CARTRIDGE CLIP HOLDER

FIELD OF THE UTILITY MODEL

The utility model relates to the field of firearm accessories and particularly to a single-slot cartridge clip holder.

BACKGROUND OF THE UTILITY MODEL

With the development of the times, countries attach increasingly great importance to their military strength. As lethal military tools, firearms are light and readily portable and therefore widely applied by soldiers to various military security aspects, thus cartridge clips as the main components of firearms are indispensible. However, the prior art generally provides one-to-one cartridge clip holders, which have a single application scope, strong pertinence, greater limitations and very poor flexibility, and therefore are adverse to coping with complicated fighting environments; and existing cartridge clip holders have unadjustable tightness, a single application scope and excessively large size, and are not light enough to cause greater carrying inconvenience, thus affecting some actions of soldiers. Accordingly, there is an urgent need for improvements on the prior art to solve the problems.

SUMMARY OF THE UTILITY MODEL

An object of the utility model is to provide a single-slot cartridge clip holder so as to solve the problems mentioned in the background art.

To achieve the above object, the utility model provides the following technical solution: a single-slot cartridge clip holder comprises a front housing, a screw hole, a rear housing, positioning rack slots and adjustable rack arms, wherein the adjustable rack aims are arranged at two sides of the front housing, the rear housing is mounted below the front housing, the positioning rack slots matching the adjustable rack aims are arranged at two sides of the rear housing, an adjustable mounting hole is arranged at a middle part of a connection between the front housing and the bottom of the rear housing, the rear housing is provided with the screw hole matching the adjustable mounting hole, a bolt is spirally mounted on the screw hole, a front housing protrusion is arranged at two sides of the front housing near one end of the adjustable mounting hole, a pressure elastic piece is arranged at an inner side of the rear housing, positioning screw holes are arranged at two sides of the pressure elastic piece near one end of the screw hole, and a groove is arranged at an inner side of the rear housing near one end of the screw hole.

Preferably, the adjustable rack arm is provided with not fewer than three sets of fixing slots, and the positioning rack slot is provided with a positioning tooth matching the adjustable rack arm.

Preferably, a smooth arc edge is arranged at a bottom edge of the adjustable rack arm.

Compared with the prior art, the utility model has the following beneficial effects: compared with a traditional cartridge clip holder, the single-slot cartridge clip holder mainly consists of two important parts, i.e. a front housing and a rear housing, wherein two sides of the front housing are buckled with two sides of the rear housing by positioning rack slots and adjustable rack arms; the movement of the front housing can be controlled by the positioning rack slots of the rear housing so as to control the dimension of the inner space to meet the demand for different dimensions of cartridge clips; fasteners for connection and fixing are arranged at the bottom of the front and rear housings to ensure the stability of the cartridge clip holder; the cartridge clip holder can be conveniently and rapidly used when attached to the waist belt for holding a cartridge clip, and is a cartridge clip holder for holding and protecting a handgun cartridge clip; the screw fastening at the bottom can enhance the firmness of a cartridge clip in the clip holder to prevent fall-off, thus better protecting the cartridge clip; the cartridge clip holder can provide rapid insertion and withdrawal, has a compact size and a wide application scope, and can be compatible with all handgun cartridge clips; soldiers can therefore handle emergencies to avoid accidents caused by errors related to cartridge clips; and multiple sets of fixing slots arranged on the adjustable rack arm can be adjusted based on the size of a cartridge clip, thus facilitating popularization and use.

In the Figures: 1—front housing; 2—adjustable mounting hole; 3—screw hole; 4—front housing protrusion; 5—rear housing; 6—smooth arc edge; 7—bolt; 8—pressure elastic piece; 9—positioning rack slot; 10—positioning screw hole; 11—groove; 12—positioning tooth; 13—adjustable rack arm.

DETAILED DESCRIPTION OF THE UTILITY MODEL

The technical solutions in the embodiments of the utility model are to be clearly and completely described below in conjunction with the drawings in the embodiments of the utility model. It is apparent that the described embodiments are only part of rather than all of the embodiments in the utility model. Based on the embodiments of the utility model, all other embodiments obtained by the ordinary persons skilled in the art without inventive work belong to the protection scope of the utility model.

Figure 1:
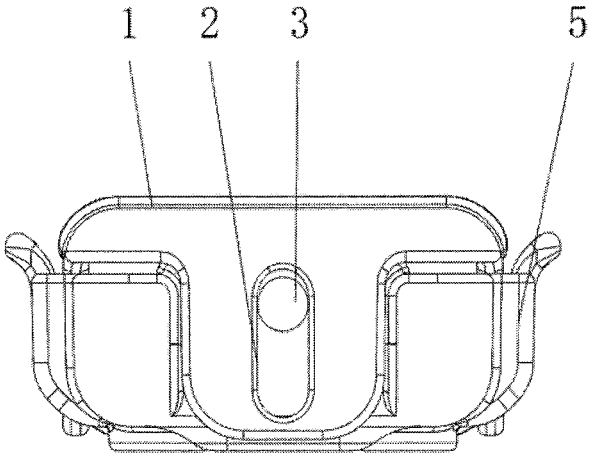
FIG. 1 is a bottom view of the utility model.
Figure 2:
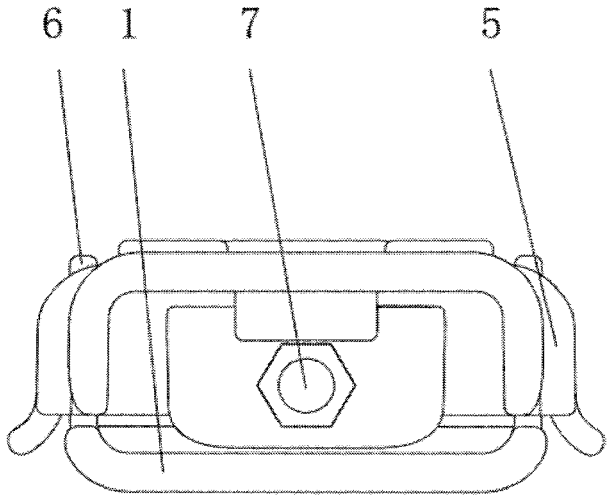
FIG. 2 is a top view of the utility model.
Figure 3:
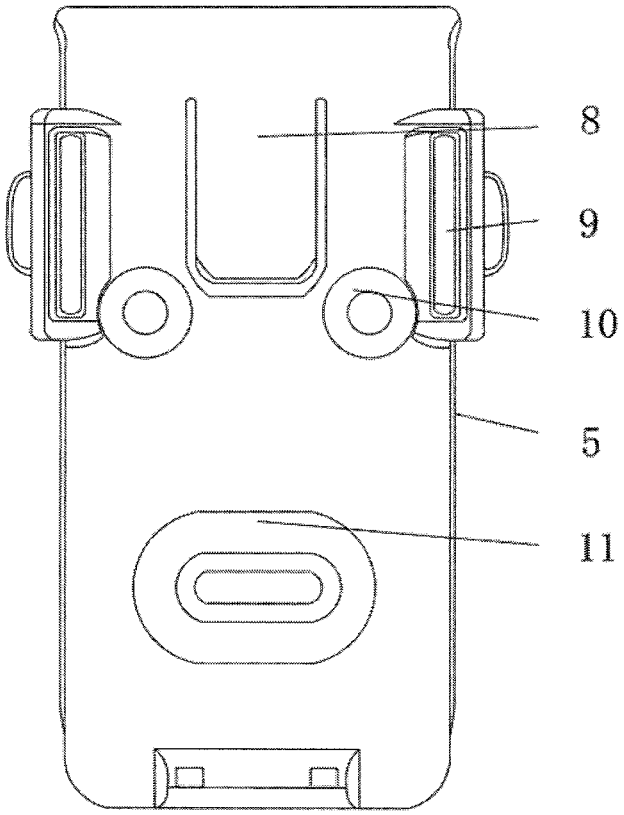
FIG. 3 is a schematic structural view of a rear housing of the utility model.
Figure 4:
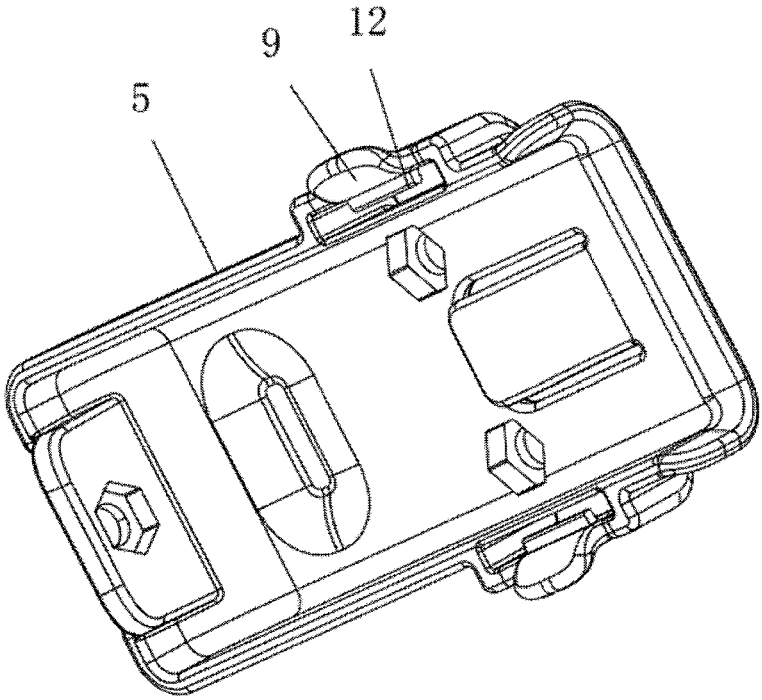
FIG. 4 is a perspective view of the rear housing of the utility model.
Figure 5:
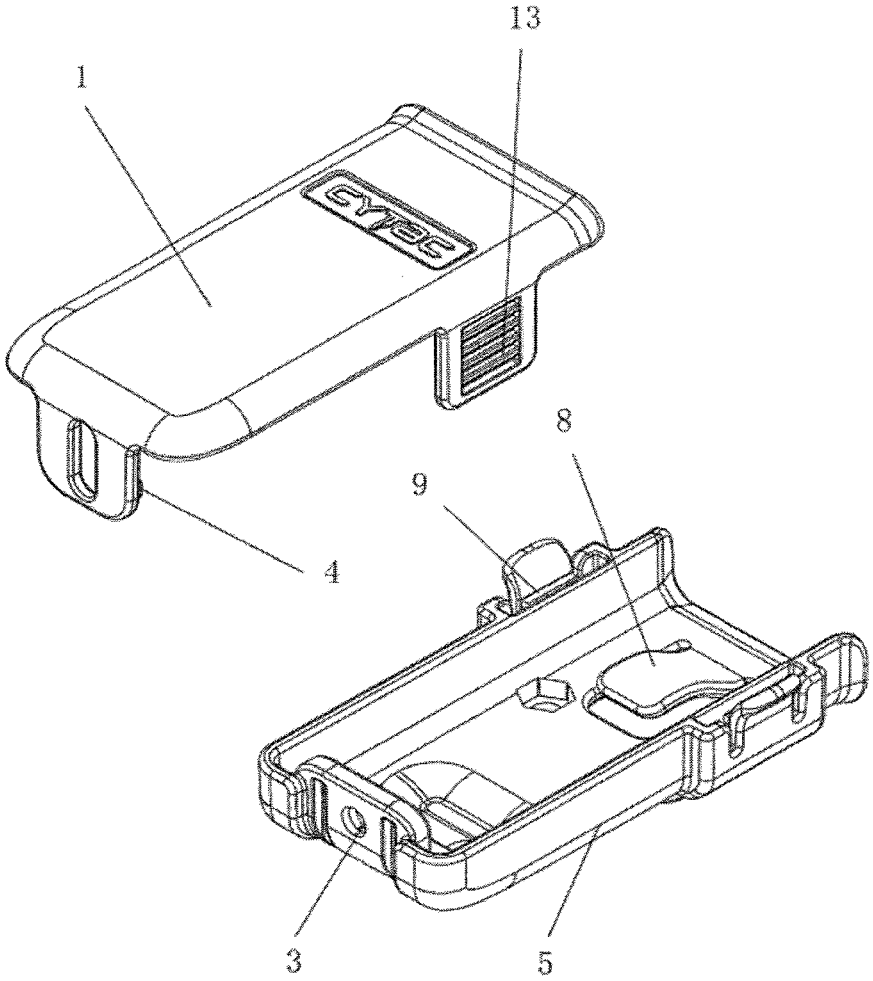
FIG. 5 is an exploded view of the utility model.
Figure 6:
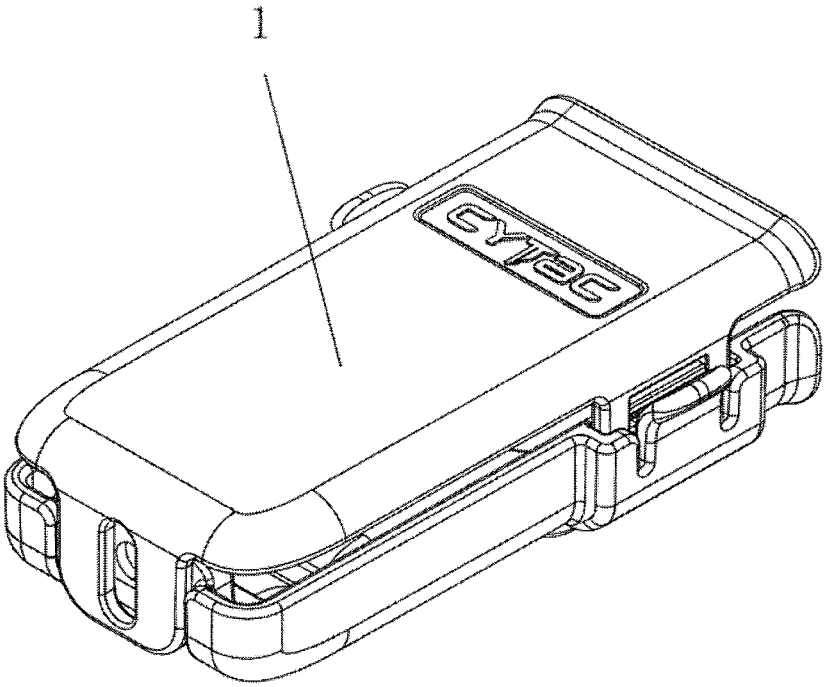
FIG. 6 is a perspective view of the overall assembly of the utility model.

Referring to FIGS. 1-6, the utility model provides an embodiment: a single-slot cartridge clip holder comprises a front housing 1, a screw hole 3, a rear housing 5, positioning rack slots 9 and adjustable rack arms 13, wherein the adjustable rack arms 13 are arranged at two sides of the front housing 1, the rear housing 5 is mounted below the front housing 1, the positioning rack slots 9 matching the adjustable rack arms 13 are arranged at two sides of the rear housing 5, the adjustable rack aim 13 is provided with not fewer than three sets of fixing slots, the positioning rack slot 9 is provided with a positioning tooth 12 matching the adjustable rack arm 13, the adjustable rack arm 13 facilitates adjusting the size of the space between the front housing 1 and the rear housing 5, a smooth arc edge 6 is arranged at a bottom edge of the adjustable rack aim 13, the smooth arc edge 6 prevents a projection of the adjustable rack arm 13 from being hooked, an adjustable mounting hole 2 is arranged at a middle part of a connection between the front housing 1 and the bottom of the rear housing 5, the rear housing 5 is provided with the screw hole 3 matching the adjustable mounting hole 2, a bolt 7 is spirally mounted on the screw hole 3, a front housing protrusion 4 is arranged at two sides of the front housing 1 near one end of the adjustable mounting hole 2, a pressure elastic piece 8 is arranged at an inner side of the rear housing 5, positioning screw holes 10 are arranged at two sides of the pressure elastic piece 8 near one end of the screw hole 3, the pressure elastic piece 8 facilitates taking and placing a cartridge clip, and a groove 11 is arranged at an inner side of the rear housing 5 near one end of the screw hole 3.

Operating principles: when in use, the front housing 1 and the rear housing 5 are mounted and fixed by the adjustable mounting hole 2 and the screw hole 3, then a cartridge clip is inserted into the space between the front housing 1 and the rear housing 5 based on the positioning screw holes 10, then the size of the space between the front housing 1 and the rear housing 5 is adjusted by the positioning teeth 12 on the positioning rack slots 9 and the adjustable rack aims 13 based on the dimension of the cartridge clip, meanwhile the inserted cartridge clip is tightly pressed between the front housing 1 and the rear housing 5 under the action of the pressure elastic piece 8 to prevent the cartridge clip from falling off, and the cartridge clip can be rapidly taken out when the pressure elastic piece 8 is pressed. For those skilled in the art, the utility model is apparently not limited to the details of the above exemplary embodiments, and the utility model can be implemented in other specific forms without departing from the spirit or basic features of the utility model. Accordingly, anyway, the embodiments should be considered to be exemplary and non-limiting. The scope of the utility model is defined by the appended claims rather than the above description, thus all changes falling within the meaning and scope of equivalent conditions of the claims are intended to be included in the utility model. Any reference numeral in the claims should not be regarded as limiting the claims involved.

The invention claimed is:

1. A single-slot cartridge clip holder, comprising a front housing (1), a screw hole (3), a rear housing (5), positioning rack slots (9) and adjustable rack aims (13), wherein the adjustable rack alms (13) are arranged at two sides of the front housing (1), the rear housing (5) is mounted at a rear part of the front housing (1), the positioning rack slots (9) matching the adjustable rack arms (13) are arranged at two sides of the rear housing (5), an adjustable mounting hole (2) is arranged at a middle part of a connection between the front housing (1) and the bottom of the rear housing (5), the rear housing (5) is provided with the screw hole (3) matching the adjustable mounting hole (2), a bolt (7) is spirally mounted on the screw hole (3), a front housing protrusion (4) is arranged at two sides of the front housing (1) near one end of the adjustable mounting hole (2), a pressure elastic piece (8) is arranged at an inner side of the rear housing (5), positioning screw holes (10) are arranged at two sides of the pressure elastic piece (8) near one end of the screw hole (3), and a groove (11) is arranged at an inner side of the rear housing (5) near one end of the screw hole (3).

2. The single-slot cartridge clip holder according to claim 1, wherein the adjustable rack arm (13) is provided with not fewer than three sets of fixing slots, and the positioning rack slot (9) is provided with a positioning tooth (12) matching the adjustable rack arm (13).

3. The single-slot cartridge clip holder according to claim 1, wherein a smooth arc edge (6) is arranged at a bottom edge of the adjustable rack arm (13).

* * * * *